United States Patent [19]

Hagelberg

[11] 4,219,144

[45] Aug. 26, 1980

[54] SERVING TRAY

[75] Inventor: Gabriella Hagelberg, Stockholm, Sweden

[73] Assignee: Bengt Petersson New Products Investment AB, Askim, Sweden

[21] Appl. No.: 958,619

[22] Filed: Nov. 8, 1978

[51] Int. Cl.[3] ..... B65D 1/36

[52] U.S. Cl. ..... 229/2.5 R; 206/563; 206/564; 229/30

[58] Field of Search ..... 206/562, 563, 524, 203; 229/2.5, 28 R, 29 M, 30

[56] References Cited

U.S. PATENT DOCUMENTS

| | | | |
|---|---|---|---|
| 1,064,108 | 6/1913 | Sundee | 206/563 |
| 1,623,877 | 4/1927 | Kjetsaa | 220/22 |
| 2,556,844 | 6/1951 | Istivan | 229/27 |
| 3,162,344 | 12/1964 | Sabol | 229/28 R |
| 3,253,766 | 5/1966 | Coe | 229/28 R |
| 3,520,409 | 7/1970 | Gibbs | 229/30 |
| 3,647,104 | 3/1972 | Garings | 229/2.5 |
| 3,915,371 | 10/1975 | Crabtree | 229/29 M |
| 3,955,672 | 5/1976 | Bundage | 229/2.5 R |

*Primary Examiner*—Herbert F. Ross

[57] ABSTRACT

The present invention relates to a serving tray for the serving of a meal comprising at least one dish and at least one drink in a drinking vessel, the tray comprising a number of recesses in the form of bowls for the components of the meal. According to the invention a hole extends through the tray is provided in shape and size to form an opening for the insertion of the thumb of a hand so that the tray can be carried with the thumb on the upper side of the tray while for the rest of the hand there is provided a downwards pointing surface against which the hand can rest and support the corresponding portion of the underside of the tray.

2 Claims, 3 Drawing Figures

SERVING TRAY

The present invention relates to a serving tray for serving dishes such as hot dogs and similar.

For most meals a plate or similar is necessary for the dish and the plate in turn needs a surface to be placed on for example the surface of a table. On the surface is also placed a fork and knife, drinking glass and other accessories for the meal. However, in certain cases a surface is not available for example when serving meals such as hot dogs and hamburgers from stands. For such meals it is common to suit the dish to the circumstances by serving food consisting of only one kind such as a hot dog without potatoes or salad and by serving the meal without any drink.

For dishes, however, where a serving vessel is necessary, disposable plates or cups are used. When holding such vessel during said circumstances one hand is occupied holding the vessel and the other has to be used for the fork or similar and there will be no possibility to hold a drinking cup. The disadvantage with such disposable serving vessel is that it can be difficult to hold when containing a hot dish as the heat is conducted to the outer surface of the vessel where the fingers are placed.

The object of the present invention is to provide preferably a disposable serving tray provided for the carrying of at least one dish and at least one drinking vessel and which tray is arranged so it can be held in a secure grip in a convenient way.

A further object of the invention is to provide a serving tray which can be held in portions of the same which are not utilized for the carrying of a hot dish.

Still another object of the invention is to provide a tray which can be made in a thin, cheap material with low stiffness and which in spite of this is provided to carry a drinking vessel as well as a dish without the need to hold the tray at the portion at which the dish is placed.

In the accompanying drawings two embodiments of the invention are shown. In

Figure 1:
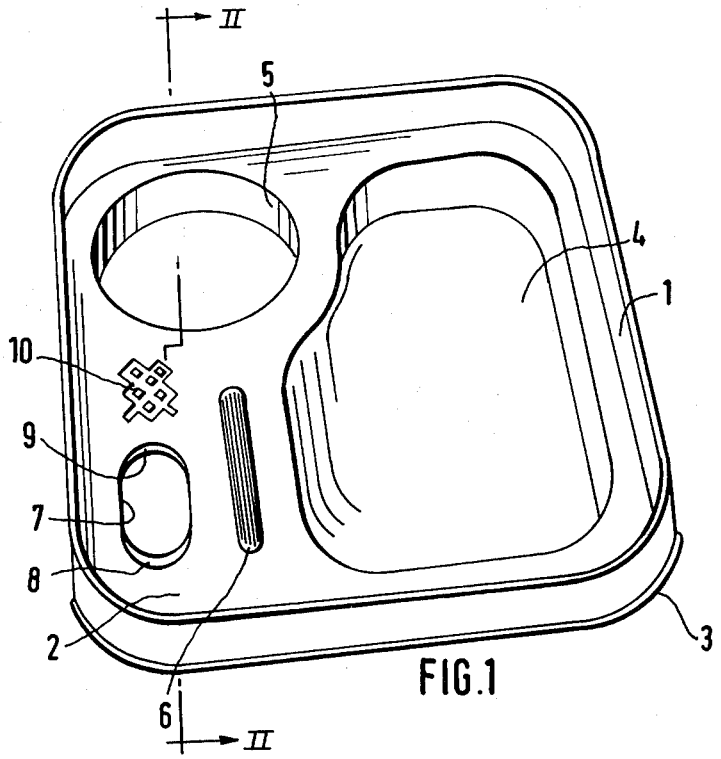

FIG. 1 the serving tray is shown in perspective and in

Figure 2:
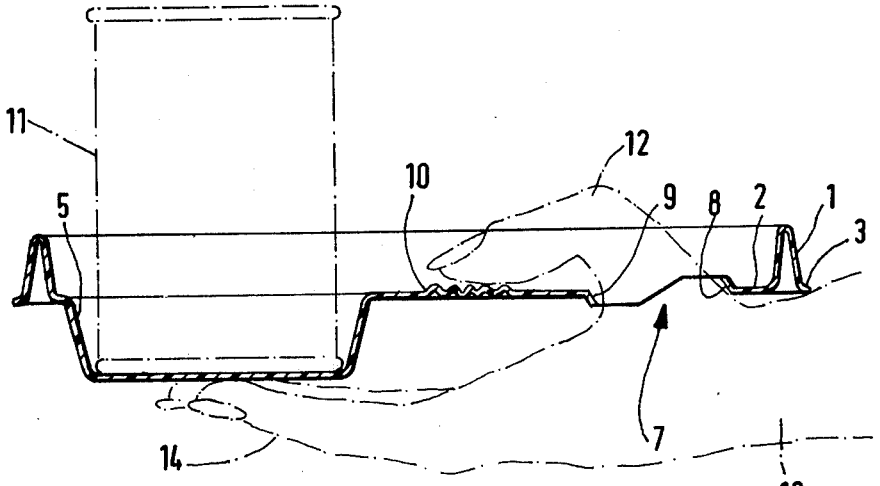

FIG. 2 the serving tray is shown in a section along the line II—II in FIG. 1.

Figure 3:
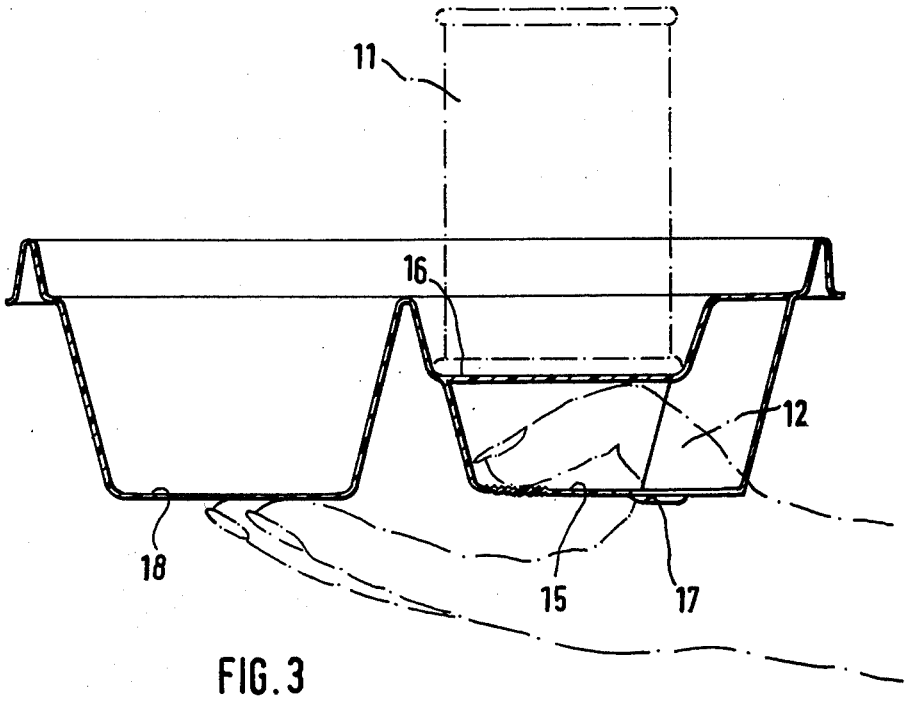

FIG. 3 shows a second embodiment.

According to the figures the serving tray is formed of a shaped piece of thin material preferably a plastic sheet shaped by means of a vacuum method. Outermost along the border of the tray an upwards pointing frame 1 extends which encloses the proper tray surface 2. The frame 1 at the inside extends upwards from the surface 2 and at the outside extends back down to the level of the surface 2 and terminates in a outwards extends border 3 which makes it possible to separate the tray of the shaping from the sheet of the material by means of punching. From the surface 2 a bowl 4 and a circular basin 5 formed in the material extend downwards. There is also a recess 6 which also is formed in the same piece of material. The basin 5 and the recess 6 and the bowl 4 are provided with bottoms which are formed of the lower portion of the piece of material.

At the border of the tray an elongated hole 7 the edge 8 of which is directed towards the frame is bent upwards and whose opposite edge 9 there is provided pointing downwards. Opposite to the edge 9 is a corrugated surface 10.

According to the second embodiment shown in FIG. 3 a recess 15 similar to the circular basin 5 in FIGS. 1 and 2 is formed with a step 16. In the bottom of the basin 15 is a hole 17 similar to the hole 7 in FIGS. 1 and 2. Also the tray of the second embodiment has a recess 18 similar to the recess 4 for a dish and a frame. However, the hole 7 is replaced by the hole 17.

In the use of the tray a dish can be arranged in the recess 4 and a lemonade or beer can 11 or other drink can be placed in the recess 5 respectively 15. The recess 6 can be used for holding a napkin or other accessories. When one desires to eat the meal the thumb 12 of the left hand 13 is inserted in the hole 7 or 17 respectively. The rest of the fingers 14 of the hand rest against the bottom of the basin 5 (or surface on underside of recess 18). The corrugated surface 10 is provided for the resting of the thumb. The edges 8 and 9 of the hole 7 (and 17) which extend upwards and downwards provide that neither the outside nor the inside of the thumb will rest against any sharp edge.

By means of said grip the tray can be held in a very secure and convenient way even if the tray is relatively weak because of using a thin and flexible material. The drinking vessel which is relatively heavy is carried without deforming of the tray as the fingers of the hand are used as support under the basin 5. In the second embodiment the drinking vessel is placed in the basin 15 and will rest on the step 16 which leaves place for the thumb at the bottom of the basin. For this embodiment the drinking vessel is carried directly by the thumb without any tendency to deform the tray. The recess 4 is supported in a rigid way by the material of the tray by means of the high frame 1. The fact that the recess 4 is partly enclosing the basin 5 which is supported by the fingers, will also increase the rigidity of the tray. Since the thumb is inserted in the hole 7 (or 17) the risk that the grip is loosened and the tray will fall down is eliminated.

The tray is to be designed according to the type of meal which it is intended for. The essential part of the tray according to the invention is the grip for the thumb in the form of a hole which makes a secure grip possible. Important is also the possibility to directly support the heaviest part of the tray where the drinking vessel is placed. The number and the form of the bowls and other recesses can be varied within wide limits.

The second embodiment according to the FIG. 3 has the advantage that no space is needed for the thumb hole which is placed under the place for the drinking vessel. In this embodiment the space used for the thumb hole according to FIG. 1 can be used for a recess for a cold dish such as a salad without the need to enlarge the tray.

I claim:

1. A tray for serving a meal, said tray having a plurality of recesses forming bowls for receiving at least one dish and at least one drink in a drinking vessel, and a peripheral boarder extending upwards from said tray and reversely bent downwardly to the level of said tray, an elongated hole extending through said tray adjacent one border portion of the tray of a size and shape adapted to receive a thumb of a hand, said hole having a first edge portion which is curved and extends upwards from the upper side of said tray, and an opposite second edge portion which is curved and extends downwards from the underside of said tray, a first resting surface including thumb positioning surface means for the print portion of the thumb formed on the upper side of said tray located adjacent said second edge portion of said hole, and a second resting surface for the print portions of the fingers of the hand formed on the underside of one of said recesses of said tray and located at a greater distance from said second edge portion of said hole than said first resting surface, whereby the tray can be gripped and carried by the hand with the thumb extending through said hole without bearing against any sharp edge and with its print portion on said first resting surface and the print portions of the fingers being against said second resting surface and supporting same.

2. A tray according to claim 1, wherein said second edge of said hole is directed towards one of said recesses which is adapted to carry said drinking vessel.

* * * * *